US010487497B1

(12) United States Patent
Aitken

(10) Patent No.: US 10,487,497 B1
(45) Date of Patent: Nov. 26, 2019

(54) TRACK SYSTEM

(71) Applicant: Douglas Aitken, Woodburg, NJ (US)

(72) Inventor: Douglas Aitken, Woodburg, NJ (US)

( * ) Notice: Subject to any disclaimer, the term of this patent is extended or adjusted under 35 U.S.C. 154(b) by 0 days.

(21) Appl. No.: 15/457,622

(22) Filed: Mar. 13, 2017

Related U.S. Application Data

(60) Provisional application No. 62/306,868, filed on Mar. 11, 2016.

(51) Int. Cl.

| | |
|---|---|
| ***E04B 2/60*** | (2006.01) |
| ***E04F 13/14*** | (2006.01) |
| *E04B 2/78* | (2006.01) |
| *E04B 1/82* | (2006.01) |
| *E04B 2/82* | (2006.01) |
| *E04B 1/94* | (2006.01) |

(52) U.S. Cl.
CPC ..... *E04B 2/60* (2013.01); *E04F 13/14* (2013.01); *E04B 1/945* (2013.01); *E04B 2/789* (2013.01); *E04B 2/828* (2013.01); *E04B 2001/8263* (2013.01); *E04B 2103/06* (2013.01)

(58) Field of Classification Search
CPC ..... E04B 2/828; E04B 2/789; E04B 2/827; E04B 2/825; E04B 2/60; E04B 2103/06; E04B 2001/8263; E04B 2001/8281; E04B 1/945; E04B 1/947; E04F 13/14
USPC ..... 52/241, 242, 243.1, 243
See application file for complete search history.

(56) References Cited

U.S. PATENT DOCUMENTS 1,130,722 A * 3/1915 Fletcher ..... E04B 2/58 52/355
1,457,303 A * 6/1923 Higgins ..... E04C 3/07 52/842
2,245,644 A * 6/1941 Braloff ..... E04B 2/767 52/241
3,271,920 A * 9/1966 Downing, Jr. ..... E04B 2/7854 52/481.1
3,397,495 A * 8/1968 Thompson ..... E04B 2/825 52/241
3,481,090 A * 12/1969 Lizee ..... E04B 2/825 52/241
3,805,471 A * 4/1974 De Schutter ..... E04B 2/7854 52/126.4
3,839,839 A * 10/1974 Tillisch ..... E04B 2/74 52/481.1
3,940,899 A * 3/1976 Balinski ..... E04B 2/7411 52/481.1
3,943,680 A * 3/1976 Balinski ..... E04B 2/7411 52/481.1
4,152,878 A * 5/1979 Balinski ..... E04B 1/941 52/481.1
4,324,082 A * 4/1982 Rutkowski ..... E04C 3/09 52/481.1

(Continued)

*Primary Examiner* — Phi D A
(74) *Attorney, Agent, or Firm* — Hamilton IP Law, PC; Jay R. Hamilton; Charles A. Damschen

(57) ABSTRACT

A track system may be configured to support drywall above a floor surface of a structure. The track system may be configured to comply with one or more building and/or material standards. The track system may comprise one or more components. A component may include a base section and a lateral section. The track system and/or components thereof may be configured such that they conform to a specified fire standard, including but not limited to ASTM E-119 one-hour and/or two-hour fire standards.

8 Claims, 8 Drawing Sheets

(56) References Cited

U.S. PATENT DOCUMENTS

| | | | | | |
|---|---|---|---|---|---|
| 4,435,936 | A * | 3/1984 | Rutkowski | E04B 2/7863 | 52/481.1 |
| 5,079,884 | A | 1/1992 | Menchetti | | |
| 5,146,723 | A * | 9/1992 | Greenwood | E04B 2/825 | 52/241 |
| 5,471,805 | A * | 12/1995 | Becker | E04B 2/7411 | 52/241 |
| 5,519,969 | A * | 5/1996 | Golba | E04D 13/1407 | 52/58 |
| 5,836,135 | A | 11/1998 | Hagan et al. | | |
| 6,145,257 | A * | 11/2000 | Cappuccio | E04B 2/8647 | 52/220.2 |
| 6,293,064 | B1 | 9/2001 | Larson | | |
| 6,298,609 | B1 | 10/2001 | Bifano et al. | | |
| 6,470,638 | B1 | 10/2002 | Larson | | |
| 7,712,267 | B2 | 5/2010 | Lehane et al. | | |
| 7,788,879 | B2 * | 9/2010 | Brandes | E04B 1/14 | 52/309.4 |
| 7,861,470 | B2 * | 1/2011 | Lehane | E04B 2/7453 | 52/169.5 |
| 8,590,231 | B2 * | 11/2013 | Pilz | E04B 2/7411 | 52/232 |
| 8,596,019 | B2 | 12/2013 | Aitken | | |
| 2005/0183361 | A1 | 8/2005 | Frezza | | |
| 2005/0229515 | A1 | 10/2005 | Ruston | | |
| 2006/0054419 | A1 | 3/2006 | Friedman et al. | | |
| 2007/0163191 | A1 | 7/2007 | Berry | | |
| 2009/0064631 | A1 | 3/2009 | Frezza | | |
| 2013/0192141 | A1 * | 8/2013 | Kopish | E05D 15/063 | 49/413 |

* cited by examiner

NOTE:
1.) CUT LENGTH TO BE 120.0" +.03/-.00 APPROX. 4.8 LB/PIECE
2.) NOMINAL COIL SLIT WIDTH TO BE 7.50" +/-.03
3.) WHEN BOTH "FEET" CONTACT HORIZONTAL SURFACE, 2.000" VERITICAL SURFACE TO BE 90° ± 2° TO HORIZONAL SURFACE (2° OVER 2" IS .07").

NOTE:
1.) CUT LENGTH TO BE 120.0" +.03/−.00 APPROX. 5.59 LB/PIECE
2.) NOMINAL COIL SLIT WIDTH TO BE 8.20" +/−.03
3.) WHEN BOTH "FEET" CONTACT HORIZONTAL SURFACE, 2.000" VERTICAL SURFACE TO BE 90° ± 2° TO HORIZONAL SURFACE (2° OVER 2" IS .07").

TRACK SYSTEM

CROSS REFERENCE TO RELATED APPLICATIONS

This utility nonprovisional patent application claims priority from provisional U.S. Pat. App. No. 62/306,868 filed on Mar. 11, 2016, which is incorporated by reference herein in its entirety.

FIELD OF THE INVENTION

The present invention is directed to improved drywall track systems that support drywall above the floor surface.

STATEMENT REGARDING FEDERALLY SPONSORED RESEARCH OR DEVELOPMENT

No federal funds were used to develop or create the disclosed invention.

REFERENCE TO SEQUENCE LISTING, A TABLE, OR A COMPUTER PROGRAM LISTING COMPACT DISK APPENDIX

Not Applicable

BACKGROUND

Stud framing is commonplace in both commercial and residential construction. Typically, a track is mounted to the ceiling and/or floor and studs are inserted into and attached to the track using, for example, screws or nails. Once the studs are installed, a wall is formed by attaching drywall, also known in the art as gypsum board, to the studs.

Drywall is very absorbent to water, and will tend to wick any moisture with which it comes in contact. This is undesirable because moist drywall can harbor and grow toxic mold. Once mold has contaminated drywall, it is very costly to eliminate, often requiring that the affected drywall be removed, discarded, and replaced with new drywall.

In order to avoid this problem, installers will tend to position the drywall so that its lower edge is above the floor surface so as to avoid the wicking of any moisture from the floor. Some methods of accomplishing this use tracks that have been adapted to include a ledge or support within the track that props the drywall above the floor surface. See, e.g., U.S. Published Patent Application Nos. 2007/0163191 and 2005/0183361. But while these prior art systems would satisfactorily support the drywall above the floor surface, they are not practicable for the commercial and residential construction business because their irregular shape often does not permit compact stacking of the track for shipping and storage. As a result, these irregularly shaped tracks will consume more storage and shipping space, leading to increased costs.

Thus, drywall track systems that support drywall above the floor, while being capable of compact stacking during shipping and storage are needed.

BRIEF DESCRIPTION OF THE DRAWINGS

The accompanying drawings, which are incorporated in and constitute a part of this specification, illustrate embodiments and together with the description, serve to explain the principles of the stalk rolls and flutes.

DETAILED DESCRIPTION - ELEMENT LISTING

Figure 1:
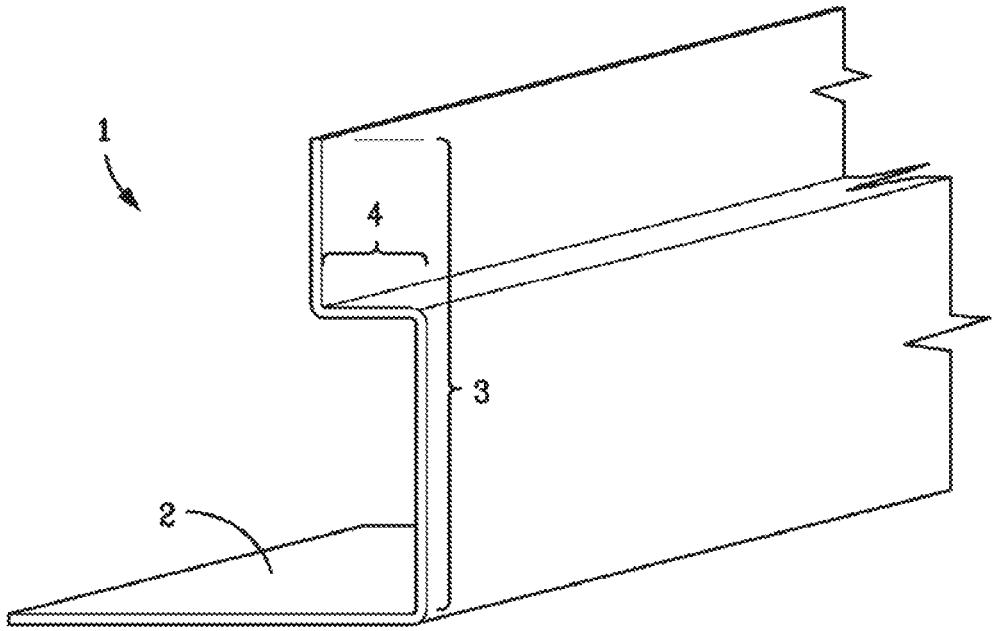
FIG. 1 depicts various aspects of a component of a track system according to the present disclosure.

| ELEMENT DESCRIPTION | ELEMENT # |
|---|---|
| Component | 1 |
| Base section | 2 |
| Lateral section | 3 |
| Niche portion | 4 |
| Fastener | 5 |
| Stud (2" × 4") | 6 |
| Stud (2" × 6") | 7 |
| Vent | 8 |
| Drainage aperture | 9 |
| Drainage aperture | 10 |
| Drainage aperture | 11 |
| Drywall | 12 |
| Track system | 20 |
| Component | 30 |
| Base section | 32 |
| Lateral section | 34 |
| First upright | 34a |
| Second upright | 34b |
| External upright | 34c |
| Niche portion | 36 |
| Cavity | 37a |
| Gap | 37b |
| Base tab | 38 |

DETAILED DESCRIPTION

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes—from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems.

This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the examples included therein and to the Figures and their previous and following description.

Figure 2A:
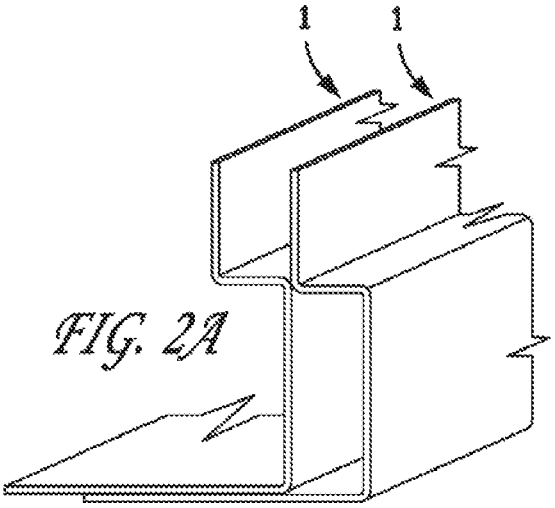
FIG. 2A depicts various aspects of two components stacked adjacent one another.
Figure 2B:
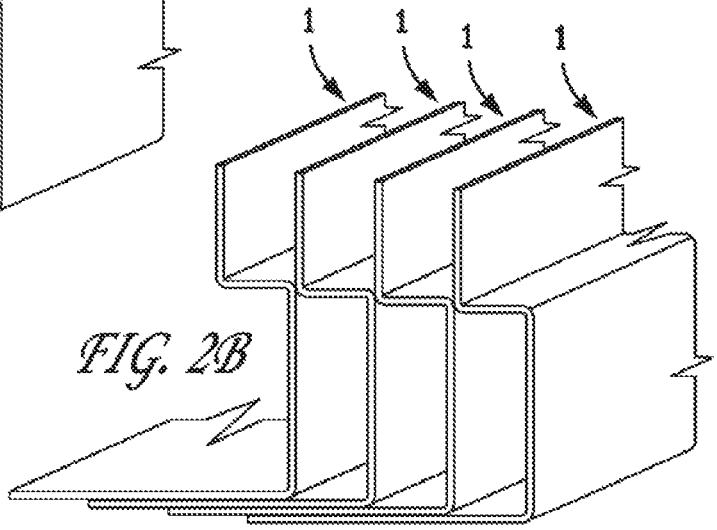
FIG. 2B depicts various aspects of four components stacked adjacent one another.

Generally, the track system 20 disclosed herein may be configured to for forming drywall track that can support drywall above the floor. While other drywall track systems may have functionality capable of supporting drywall above the floor, those systems are described as a single unit. The track systems 20 disclosed herein preferably include at least two components 1, 30, which may be generally narrower than the single units of the prior art, but may be stackable within each other. The stackability of the components 1, 30 of the track system 20 may facilitate the shipping and storage of the components 1, 30, as stacking reduces the overall volume of the components", 30, hence leading to decreased shipping and storage costs. Various aspects of such stacking of components 1, 30 are shown at least in FIGS. 2A and 2B. Once the track system 20 is assembled, it can be used in any fashion known to those skilled in the art for installing drywall and forming walls, partitions, and/or other structures without limitation unless so indicated in the following claims. The track system 20 and components 1, 30 and/or features thereof can be further illustrated by reference to the accompanying figures. These figures are illustrative only, and are not intended to limit the scope of the track system 20 and/or any component", 30 and/or feature thereof unless so indicated in the following claims.

As depicted in FIG. 1, each component 1 of the track system 20 may consist essentially of a base section 2 and a lateral section 3, with the base section 2 being substantially perpendicular to the lateral section 3. The components of the component 1 can be fabricated from any materials suitable for use in drywall application. Preferably, the components 1, 30 may be fabricated from a metal such as steel, but the scope of the present disclosure is not so limited unless so indicated in the following claims.

The lateral section 3 may include a niche portion 4 that may be adapted for supporting drywall 12 (as shown at least in FIGS. 3A and 3B) above the base section 2, and hence the floor of a structure. In an aspect, the component 1 may be configured such that the component 1 separates the bottom edge of the drywall 12 from the base section 2 of the component 1 by a distance of at least 0.5. However, the specific distance of this separation in no way limits the scope of the track system 20 unless so indicated in the following claims. The niche portion 4 may be of such a depth so as to accommodate at least one sheet of drywall 12. Commercially available drywall is typically between 0.25 and 0.75 inches thick. Accordingly, it is contemplated that for many applications the niche portion 4 may be from about 0.25 inches to at least 0.75 inches deep to support a standard drywall sheet 12. However, the specific dimensions of the niche portion 4 in no way limit the scope of the track system 20, component 1, 30, and/or feature thereof as disclosed herein unless so indicated in the following claims. For example, it is envisioned that in an aspect of the track system 20, one or more components 1, 30 may can be adapted to accommodate more than one sheet of drywall 12, or thicker sheets of drywall 12, by increasing the depth of the niche portion 4 accordingly.

As shown in the various figures, the niche portion 4 may also be positioned within the lateral section 3 such that drywall 12 seated upon it will be supported above the base section 2, and hence, the floor surface of a structure. The niche portion 4 may be positioned such that drywall 12 seated on it is at least 0.5 in. above the base section 2 as previously described. It is contemplated that for many applications, the niche portion 4 may be positioned such that drywall 12 seated thereon is at least about 1 in. above the base section 2. However, in other aspects of a track system 20 and/or component 1, 30 and/or thereof, the niche portion 4 may be positioned such that bottom edge of the drywall 12 may be about 1.5 inches, about 2 inches, or higher above the base section 2. The optimal distance between the bottom edge of the drywall and the base section 2 may vary from one application of the track system 20 to the next, and is therefore in no way limiting to the scope thereof unless so indicated in the following claims.

Figure 3A:
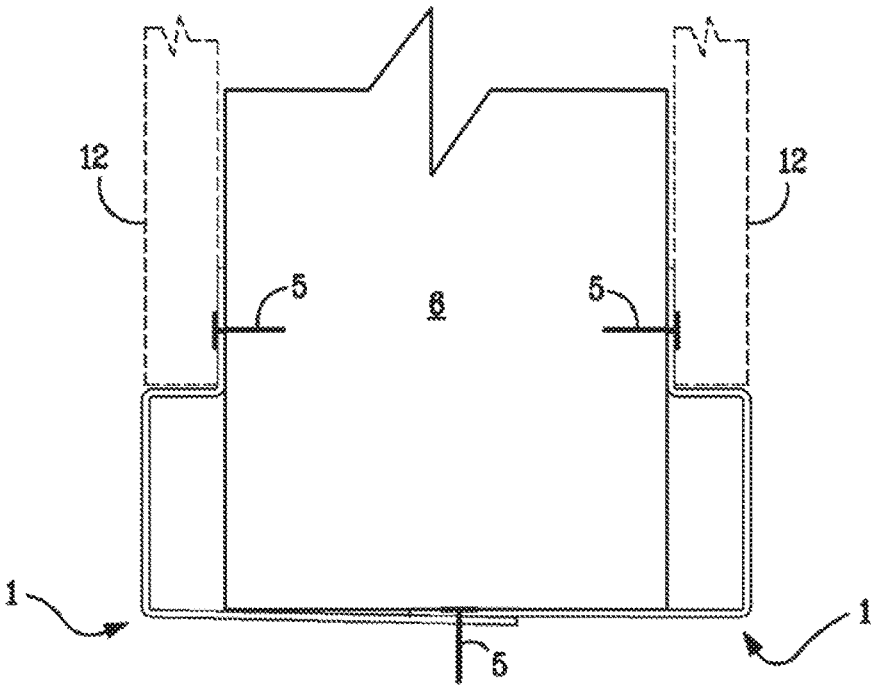
FIG. 3A depicts aspects of a component that may be configured to accommodate a two-inch-by-four-inch stud.
Figure 3B:
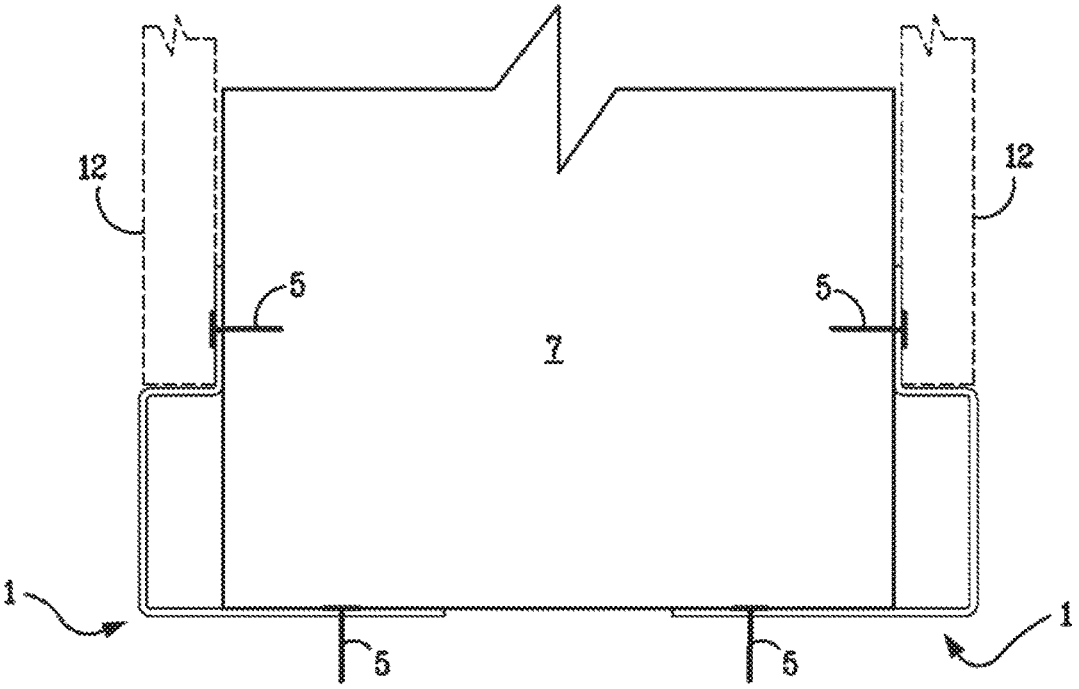
FIG. 3B depicts aspects of a component that may be configured to accommodate a two-inch-by-six-inch stud.

The base section 2 of each component may be configured such that the base sections 2 of the two components 1, 30 can be connected such that the components are in opposing relation to each other to form a drywall track, illustrative aspects of which are shown at least in FIGS. 3A and 3B. In an aspect, the base sections 2 may be connected such that opposing base sections 2 abut one another. In certain aspects, the base sections 2 can be joined together to form a drywall track. For example, in some aspects, one base section 2 may be positioned over another base section 2 and the two components 1, 30 then may be joined together using any suitable fastener 5 known to those skilled in the art or later developed, as shown at least in FIGS. 3A and 3B. Preferred fasteners include but are not limited to nails, bolts, and screws.

Referring to FIGS. 3A and 3B, in certain aspects of the track system 20, the base sections 2 of a component 1, 30 may be complementarily sized such that the width of a drywall track may be adjusted by sliding one base section 2 of one component 1, 30 over a second, opposing base section 2 of another component 1, 30. In such an aspect, the drywall track can be adjusted to accommodate at least two-inch-by-three-inch studs, two-inch-by-four-inch studs 6, or two-inch-by-six-inch studs 7, for example. It is contemplated that virtually any width may be accommodated by sliding the components 1, 30 closer together or farther apart. Once the desired width is achieved, the base sections 2 may be joined together or otherwise affixed using any fastener 5 known in the art or later developed without limitation unless so indicated in the following claims.

Figure 4:
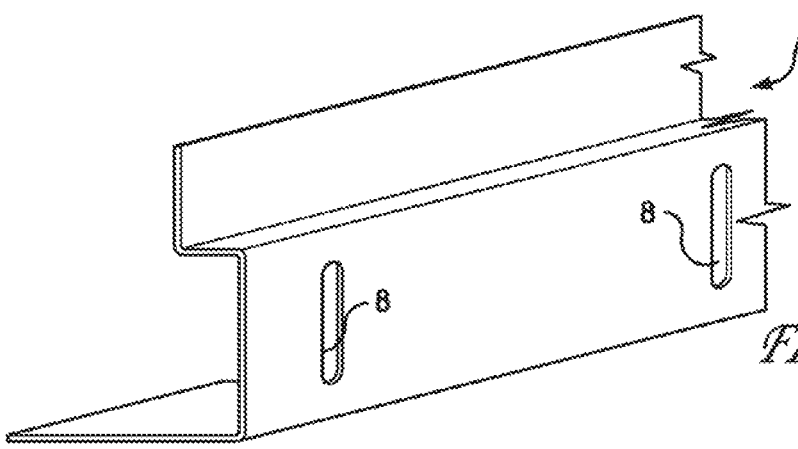
FIG. 4 depicts aspects of a component that may be configured to include vents.

The components 1, 30 of the track system 20 may also comprise at least one vent 8, which vent 8 may be configured to allow for air circulation through the track system 20. These vents 8 may be located on either the base section 2 or the lateral section 3 of the component 1, 30. It is contemplated that for many applications it may be advantageous to position the vent 8 on the lateral section 3. More specifically, it is contemplated that it may be especially advantageous for certain applications to position the vent 8 below the niche portion 4 of the lateral section 3. The vents 8 may be of any size or shape, but it is contemplated that for many applications it may be advantageous to configure the vent 8 as an elongated opening in the component 1, 30 as shown at least in FIG. 4. However, the specific number, shape, location, size, and/or configuration of the vent 8 in no way limits the scope of the track system 20 and/or component 1, 30 unless so indicated in the following claims.

Figure 5A:
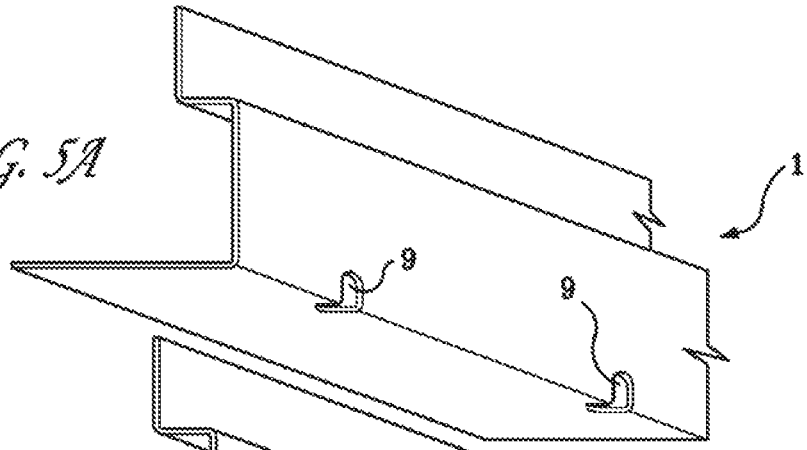
FIGS. 5A, 5B, and 5C depict aspects of a component that may be configured to include drainage apertures.
Figure 5B:
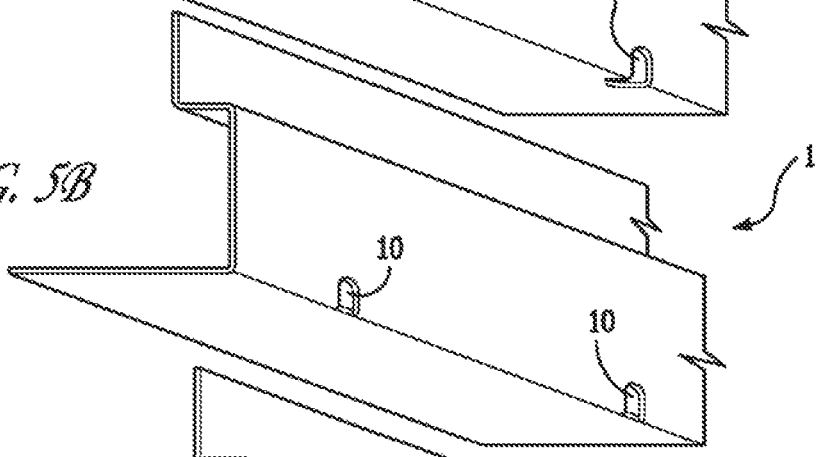
Figure 5C:
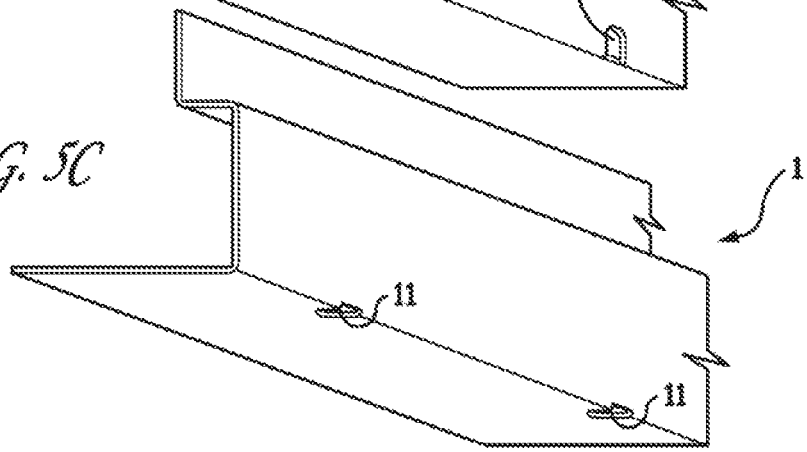

A component 1, 30 of the track system 20 may also include at least one drainage aperture 9, 10, 11. The inclusion of a drainage aperture 9, 10, 11 may be convenient in the event water, or some other liquid, enters the track system 20. In such instances, the drainage aperture 9, 10, 11 may provide a convenient path for the liquid to drain out of the track system 20. It is contemplated that for some applications it may be desirably to position the drainage aperture 9, 10, 11 so that at least a portion of the drainage aperture 9, 10, 11 is on the base section 2 of the component 1, 30, as shown at least in FIGS. 5A and 5C. In an aspect, it may be especially advantageous to position the drainage aperture 9, 10, 11 at the junction between the base section 2 and the lateral section 3, such that the drainage aperture 9, 10, 11 may be positioned at least partially in both the base and lateral sections 2, 3, respectively, as shown at least in FIG. 5A. In other aspects, the drainage aperture 9, 10, 11 may be located primarily on the lateral portion 3 of the component 30 as shown at least in FIG. 5B, In still other aspects, the drainage aperture 9, 10, 11 may be located primarily on the base section 11. The drainage apertures 9, 10, 11 may be of any size or shape, and the specific number, shape, location, size, and/or configuration of the drainage apertures 9, 10, 11 in no way limits the scope of the track system 20 and/or component 1, 30 unless so indicated in the following claims.

The components 1, 30 of the track system 20 may be of any desired length. It is contemplated that for many applications it may be preferred to have lengths of the components 1, 30 that are 8 feet, 10 feet, 12 feet, and/or 16 feet, without limitation unless so indicated in the following claims.

Also within the scope of the track system 20 as disclosed herein is the use of only one component 1, 30 of the track system 20 as a drywall track, as depicted at least in FIGS. 1, 4, 5A, 5B, and 5C. Generally, it is contemplated that such an aspect may be employed on an exterior wall of a structure, but the scope of the present disclosure is not so limited unless so indicated in the following claims. In such an aspect, the drywall track may comprise a base section 2 substantially perpendicular to a lateral section 3, wherein the lateral section 3 may include a niche portion 4 adapted for supporting drywall 12 above the base section 2. It is contemplated that the drywall track may comprise a base section 2 substantially perpendicular to a lateral section 4, wherein the lateral section 4 may include a niche portion 4 adapted for supporting drywall 12 above the base section 2. An aspect of any track system 20 and/or component 1, 30 disclosed herein may also include vents 8 and/or drainage apertures 9, 10, 1 as described above.

Fire-Rated Track System and Component

Figure 6A:
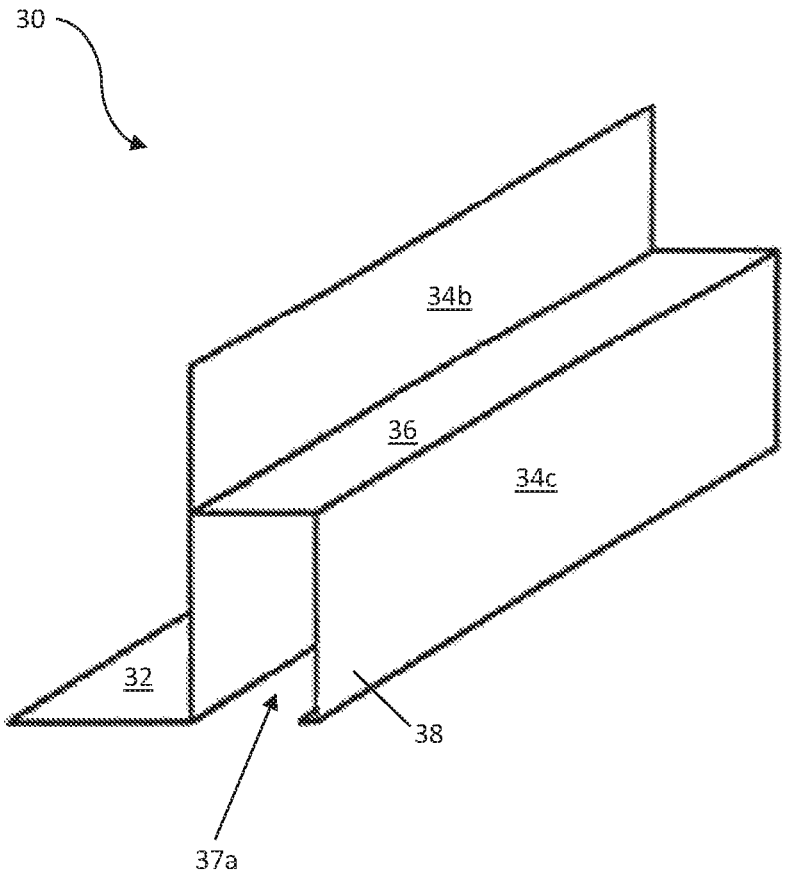
FIG. 6A provides a perspective view of another component of a track system showing various aspects of the component.
Figure 6B:
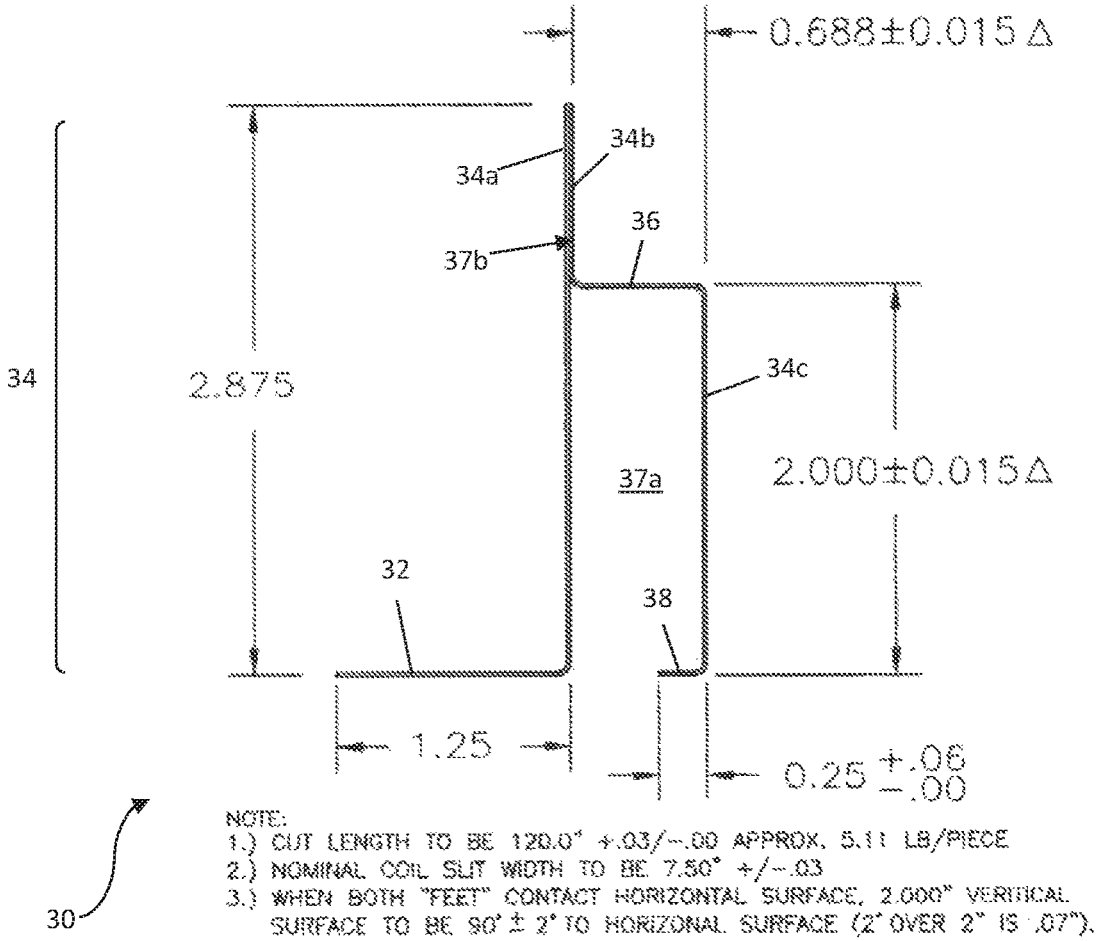
FIG. 6B is an end view of the component shown in FIG. 6A, wherein illustrative dimensions are shown for various elements of the component.
Figure 6C:
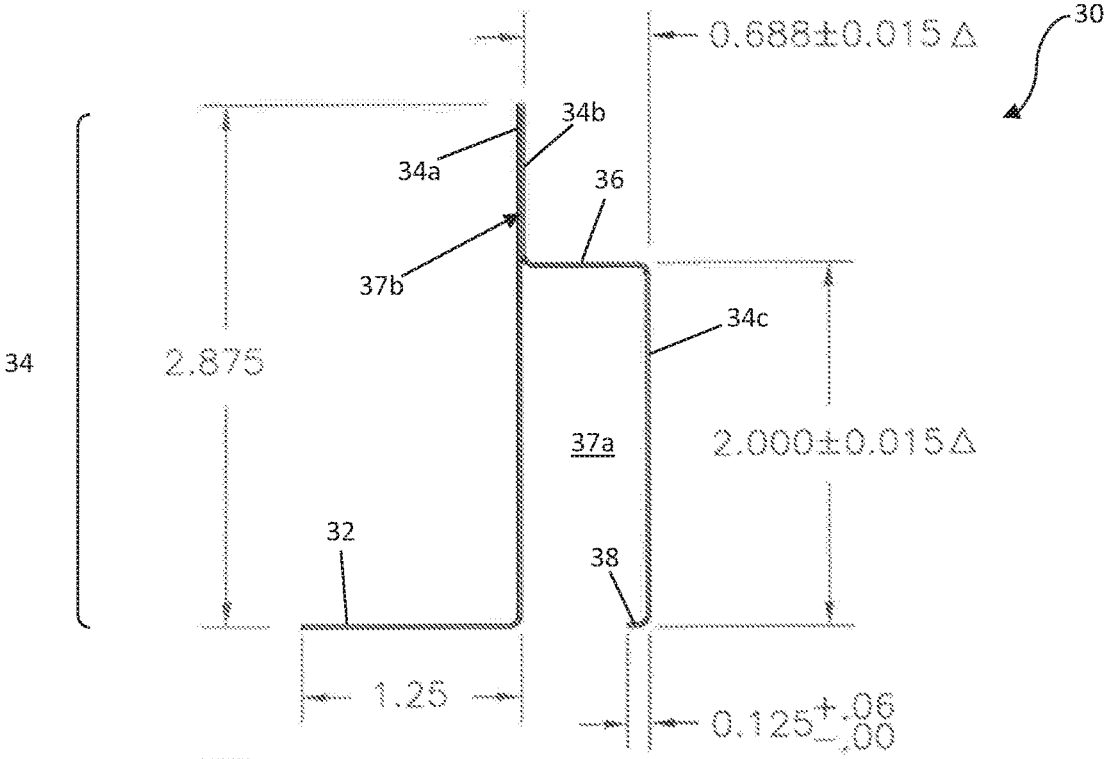
FIG. 6C is an end view of a component similar to that shown in FIGS. 6A & 6B, wherein illustrative dimensions are shown for various elements of the component.

In another aspect of a track system 20 and/or component 30 thereof, the component 30 may be configured such that it will pass a fire test. Specifically, in an aspect a component 30 may be configured such that a track system 20 may comply with one or more building and/or material standards. For example, it may be desirable to configure a component 30 to comply with a standard from the American Society for Testing and Materials ("ASTM"). Applicant has found via independent testing that an aspect of a component 30 shown in FIGS. 6A-6C is that a track system 20 comprised of those components 30 so configured complies with ASTM E-119 one-hour fire standard. However, in another aspect of a track system 20 and/or component 30 used therewith, the track system 20 and/or component 30 may be configured to comply with other building and/or material standards without limitation unless so indicated in the following claims.

Referring still to FIGS. 6A-6C, the component 30 may comprise a base section 32 and a lateral section 34. The base section 32 may engage a first upright 34*a* of the lateral section 34 in a generally perpendicular manner. The first upright 34*a* may engage a second upright 34*b* in a generally parallel manner, and such that a gap 37*b* may be formed between the interior surface of the first upright 34*a* and the interior surface of the second upright 34*b*. The first upright 34*a* may engage the second upright 34*b* at an end of the first upright 34*a* that is opposite the end thereof at which the first upright 34*a* engages the base section 32, as shown in FIGS. 6B & 6C.

The second upright 34*b* may engage a niche portion 36 in a generally perpendicular manner. The second upright 34*b* may engage the niche portion 36 at an end of the second upright 34*b* that is opposite the end thereof at which the second upright 34*b* engages the first upright 34*a*. An external upright 34*c* may engage the niche portion 36 in a generally perpendicular manner, and such that a cavity 37*a* may be formed between the interior of the external upright 34*c* and a portion of the interior surface of the first upright 34*a*. Generally, the gap 37*b* and cavity 37*a* may be in fluid communication with one another. The external upright 34*c* may engage the niche portion 36 at an end of the niche portion 36 that is opposite the end thereof that is engaged with the second upright 34*b*.

Finally, a base tab 38 may engage the external upright 34*c* in a generally perpendicular manner. The base tab 38 may engage the external upright 34*c* at an end of the external upright 34*c* that is opposite the end thereof that is engaged with the niche portion 36. Accordingly, in an aspect the base section 32, niche portion 36, and base tab 38 may generally be oriented such that they are substantially parallel with respect to one another, or such that they are parallel with respect to one another. The first upright 34*a*, second upright 34*b*, and external upright 34*c* may generally be oriented such that they are substantially parallel with respect to one another, or such that they are parallel with respect to one another. Further, in another aspect the base section 32, niche portion 36, and base tab 38 may generally be oriented such that they are substantially perpendicular with respect to the first upright 34*a*, second upright 34*b*, and external upright 34*c*, or such that they are perpendicular with respect to one another.

Generally, it is contemplated that a base tab 38 may at least improve an aesthetic feature of the track system 20 and/or component 30 as the interface between the external upright 34*c* and the base tab 38 may be smooth, rounded, and/or otherwise visually appealing. Additionally it is contemplated that a base tab 38 may increase the safety of the track system 20 and/or component 30 in that inclusion of a base tab 38 may prevent exposure to a terminal portion of the component 30, which exposure may cause items (e.g., clothing, cleaning equipment, etc.) to catch on the track system 20 and/or component 30 and/or which exposure may present a hazard to people via scraping, cutting, etc. via contact with the terminal portion of the component 30.

It is contemplated that it may be advantageous for all the various portions of the component 30 shown in FIGS. 6A-6C to be formed from one integral piece of material rather than separately forming various elements thereof and later engaging the elements with one another. However, the scope of the track system 20 and/or component 30 is not limited by the manufacturing process thereof unless so indicated in the following claims.

Generally, the component shown in FIG. 6B may be configured such that it identical to that shown in FIG. 6C but for the dimension of the base tab 38. As shown in FIG. 6B, the base tab 38 may be configured such that it extends inward from the bottom edge of the external upright 34*c* by between 0.25 and 0.31 inches. However, the base tab 38 in the component 30 shown in FIG. 6C may be configured such that it extends inward from the bottom edge of the external upright 34*c* by between 0.125 and 0.185 inches. Accordingly, the scope of the present disclosure is not limited by the specific dimensions of the base tab 38 unless so indicated in the following claims.

Figure 7A:
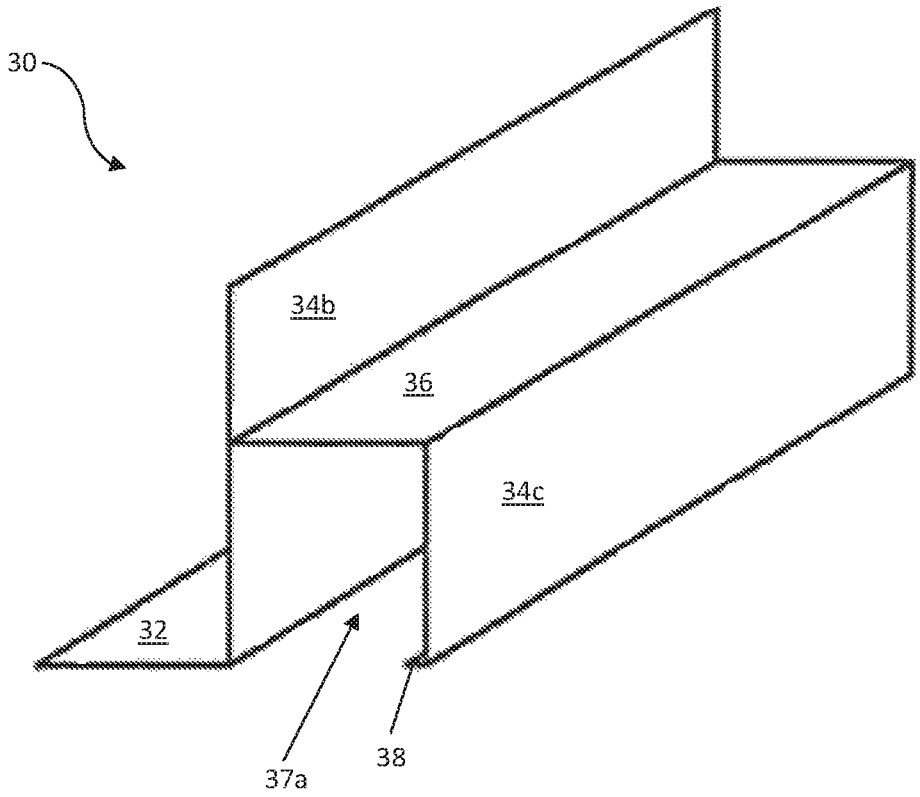
FIG. 7A provides a perspective view of another component of a track system showing various aspects of the component.
Figure 7B:
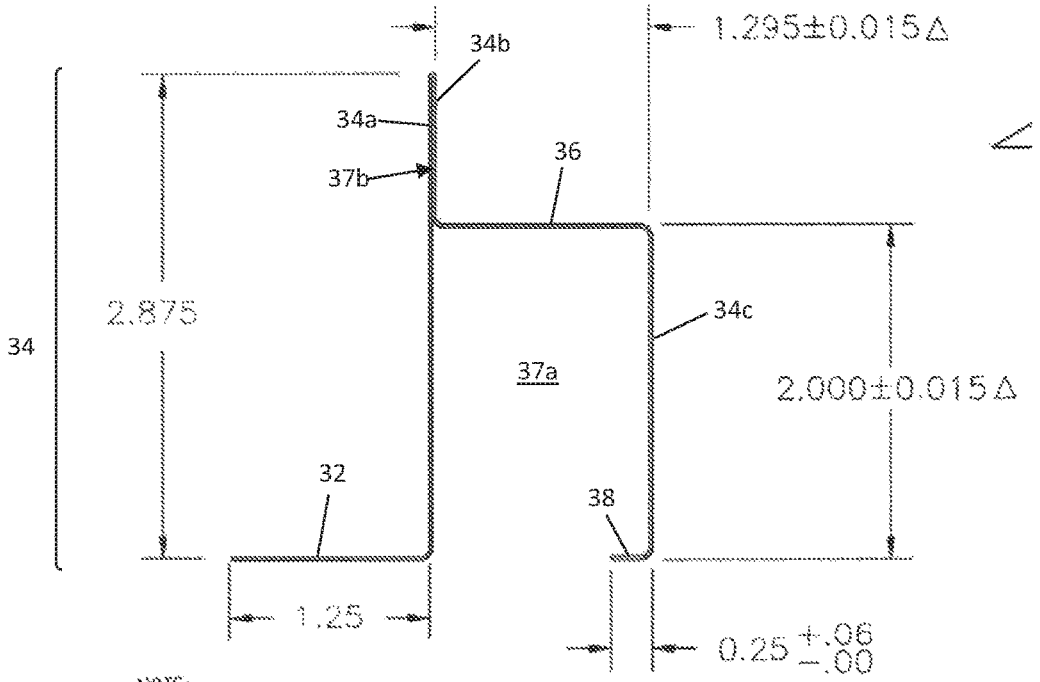
FIG. 7B is an end view of the component shown in FIG. 7A, wherein illustrative dimensions are shown for various elements of the component.
Figure 7B:
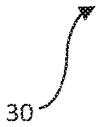

Other aspects of a component 30 are shown in FIGS. 7A and 7B, which component 30 is similar to that shown in FIGS. 6A and 6B. Applicant has found via independent testing that an aspect of a component 30 shown in FIGS. 7A and 7B is that a track system 30 comprised of those components 30 complies with ASTM E-119 two-hour fire standard. However, in another aspect of a track system 20 and/or component 30 used therewith, the track system 20 and/or component 30 may be configured to comply with other building and/or material standards without limitation unless so indicated in the following claims.

As will be apparent from a comparison between FIGS. 6B and 7B, a difference between a component 30 configured to comply with the ASTM E-119 one-hour standard and a component 30 configured to comply with the ASTM E-119 two-hour standard may be the length of the niche portion 36, and/or the distance between the interior surface of a portion of the first upright 34*a* and the interior surface of the external upright 34*c*, which may increase at least the width of the cavity 37*a*. For example, as shown in FIG. 6B, the niche portion 36 for that component 30 may be approximately 11/16 of an inch in length, such that the horizontal distance from the first upright 34*a* to the external upright 34*c* may be approximately ¾ of an inch (the length of the niche portion 36 plus the width of the gap 37*b*, which may also approximately equal the width of the cavity 37*a*). It is contemplated that the horizontal distance between the first upright 34*a* and the external upright 34*c* may be directly proportional to the time-standard for fire rating. That is, the further this distance, the longer the time in compliance with a fire-rating standard.

The component 30 shown in FIG. 7B, which may be configured to comply with the ASTM E-119 two-hour standard, may employ a longer niche portion 36 compared to that shown in FIG. 6B. As shown in FIG. 7B, the niche portion 30 may be approximately 1 and 5/16 of an inch in length, such that the horizontal distance from the first upright 34*a* to the external upright 34*c* may be approximately 1 and ¼ inches (the length of the niche portion 36 plus the width of the gap 37*b*, which may also approximately equal the width of the cavity 37*a*). Accordingly, the component 30 may be modified within the scope of the present disclosure by adjusting the length of the niche portion 36 and/or the width of the gap 37*b* and/or the width of the cavity 37*a* to comply with different building and/or material standards without limitation unless so indicated in the following claims.

Various illustrative dimensions of the several elements of components 30 are shown in FIGS. 6B and 7B. These dimensions are not intended to be restrictive, but instead illustrative of certain aspects of a component 30 unless so indicated in the following claims. Additionally, the components 30 shown in FIGS. 6A & 7A are drawn to scale, but the relative dimensions of the various features and/or elements of a component 30 are not limited to the specific configurations disclosed herein unless so indicated in the following claims. Accordingly, the scope of the track system 20 and/or component 30 is not limited by the specific dimensions and/or relative dimensions of the various elements thereof unless so indicated in the following claims.

It is contemplated that the components 30 shown in FIGS. 6A, 6B, 7A, and 7B may include drainage apertures 9, 10, 11 and/or vents 8 as previously described for other components 1 pictured herein. Further, it is contemplated that the components 30 shown herein may provide the adjustability feature for various-sized studs 6, 7 and the stacking features for transport and storage as previously described for other components 1 pictured and disclosed herein.

Any shape, dimensions, and/or configuration of a track system 20, component 1, 30 and/or element of any of the foregoing may be used within the scope of the present disclosure without limitation unless so indicated in the following claims.

The materials used to construct track system 20, component 1, 30 and/or various elements thereof will vary depending on the specific application thereof, but it is contemplated that metals, metal alloys, synthetic materials, and/or combinations thereof may be especially useful for the track system 20 and/or components 1, 30 in some applications. In an aspect it is contemplated that the track system 20 and/or component 1, 30 may be constructed of ASTM A1003 Galvanized Carbon Steel Coil, with a 0.0179 inch minimum uncoated thickness and a 0.0186 inch minimum coated thickness, which may be G40 hot-dipped galavanized per ASTM A653, cold formed coil. However, the above-referenced elements may be constructed of any material known to those skilled in the art or later developed, which material is appropriate for the specific application of the present disclosure without departing from the spirit and scope of the present disclosure unless so indicated in the following claims.

Having described the preferred embodiments, other features of the present disclosure will undoubtedly occur to those versed in the art, as will numerous modifications and alterations in the embodiments as illustrated herein, all of which may be achieved without departing from the spirit and scope of the present disclosure. Accordingly, the methods and embodiments pictured and described herein are for illustrative purposes only. Specifically, although the present disclosure is directed largely to use with drywall, the track system 20 and/or component 1, 30 may be configured for use with other material, including but not limited to paneling, plaster, laths, etc. without limitation unless so indicated in the following claims.

Any of the various features for the track system 20 and/or components 1, 30 and/or elements of any of the foregoing may be used alone or in combination with one another (depending on the compatibility of the features) from one embodiment and/or aspect of the track system 20 and/or component 1, 30 to the next. Accordingly, a nearly infinite number of variations of the track system 20 and/or component 1, 30 exist. All of these different combinations constitute various alternative aspects of the track system 20 and/or component 1, 30. The embodiments and aspects described herein explain the best modes known for practicing the track system 20 and/or component 1, 30 and will enable others skilled in the art to utilize the same. The claims are to be construed to include alternative embodiments to the extent permitted by the prior art.

Modifications and/or substitutions of one feature for another in no way limit the scope of the track system 20 and/or component 1, 30 unless so indicated in the following claims.

It should be noted that the present disclosure is not limited to the specific embodiments pictured and described herein, but are intended to apply to all similar apparatuses and methods for providing any of the features and/or advantages of any aspect of the present disclosure unless so limited by the following claims. Modifications and alterations from the described embodiments will occur to those skilled in the art without departure from the spirit and scope of the present disclosure.

Having described the preferred embodiment, other features, advantages, and/or efficiencies of the track system 20 and/or components 1, 30 will undoubtedly occur to those versed in the art, as will numerous modifications and alterations of the disclosed embodiments and methods, all of which may be achieved without departing from the spirit and scope of the track system 20, component 1, 30, and/or the present disclosure.

What is claimed is:

1. A system for forming drywall track comprising:

a. at least two components that are stackable within each other, each component consisting of:

i. a planar base section, wherein said planar base section occupies a first plane, and wherein said first plane is substantially horizontal;

ii. a lateral section engaged with said base section, said lateral section comprising:

1. a first upright engaged with and extending upward from said planar base section, wherein said first upright is perpendicular to said planar base section, and wherein said first upright is planar;
2. a second upright engaged with and substantially parallel to said first upright, wherein said second upright is positioned immediately adjacent to said first upright such that a gap between said first and second uprights is negligible, and wherein said second upright is planar;
3. a niche portion engaged with and substantially and substantially perpendicular to said first and second uprights;
4. an external upright engaged with and substantially perpendicular to said niche portion, wherein said external upright is spaced apart from said first upright by a distance adequate to pass a known fire standard test, and wherein a terminal end of said external upright extends to and terminates at said first plane, and wherein said external upright is planar;

iii. the base section of each component is configured such that the base sections of the two components can be connected such that the components are in opposing relation to each other to form the drywall track, wherein said at least two components are fire-rated.

2. The system of claim 1 wherein said lateral section further comprises a base tab engaged with and substantially perpendicular to said external upright.

3. The system of claim 2 wherein a width of said base section of each said component is defined as between 0.5 and 2.5 inches.

4. The system of claim 2 wherein a width of said base section of each said component is defined as 1.25 inches.

5. The system of claim 2 wherein a height of said lateral section of each said component is defined as between 1.0 and 3.5 inches.

6. The system of claim 2 wherein a height of said lateral section of each said component is defined as 2.875 inches.

7. The system of claim 2 wherein a width of said niche portion of each said component is defined as between 0.25 and 3.0 inches.

8. The system of claim 2 wherein a width of said niche portion of each said component is defined 0.6875 inches.

* * * * *